US005927197A

United States Patent [19]

Surya

[11] Patent Number: 5,927,197

[45] Date of Patent: Jul. 27, 1999

[54] TENSIONER AND SYSTEM FOR CONTINUOUS PRINTER SHEET ADVANCEMENT

[75] Inventor: Ronald Surya, Laguna Hills, Calif.

[73] Assignee: Troy Systems, Inc., Santa Ana, Calif.

[21] Appl. No.: 09/112,977

[22] Filed: Jul. 9, 1998

[51] Int. Cl.[6] ..... B41F 5/04

[52] U.S. Cl. ..... 101/219; 101/181; 101/228; 101/242

[58] Field of Search ..... 101/181, 228, 101/242, 219; 226/195; 242/348; 354/108, 277; 396/511

[56] References Cited

U.S. PATENT DOCUMENTS

| | | | |
|---|---|---|---|
| 3,854,672 | 12/1974 | Tilban | 242/75.2 |
| 3,936,008 | 2/1976 | Crum | 242/75.44 |
| 4,008,483 | 2/1977 | Swift et al. | 354/277 |
| 4,304,471 | 12/1981 | Jones | 354/108 |
| 4,722,275 | 2/1988 | Taguchi et al. | 101/228 |
| 5,127,323 | 7/1992 | Lindblom | 101/228 |
| 5,176,371 | 1/1993 | Rau et al. | 270/42 |
| 5,809,358 | 9/1998 | Weber | 396/511 |

*Primary Examiner*—John Hilten
*Assistant Examiner*—Charles H. Nolan, Jr.
*Attorney, Agent, or Firm*—Price Gess & Ubell

[57] ABSTRACT

A tensioner and tensioning system for maintaining tension in a printer liner while providing manual advancement of the printer liner without accessing the inner compartment of the printer. A tension comprises first and second end brought in proximity to form a channel, and a middle portion formed into a circular configuration to hold the roll of printer liner. A stopper is included within the channel between the two ends which resists movement of the liner and promotes tension. The liner is preferably advances against the resistance of the tensioner by a take-up roller cooperating with a one-directional clutch which advances the liner without relaxation to maintain tension. The one-directional clutch is operated from an external area on the printer to enable the manual advancement of the liner without accessing the printer's inner compartment.

6 Claims, 3 Drawing Sheets

TENSIONER AND SYSTEM FOR CONTINUOUS PRINTER SHEET ADVANCEMENT

BACKGROUND OF THE INVENTION

1. Field of the Invention

The present invention relates generally to large industrial type printing machines, and more particularly to a system for mounting and advancing a printer liner within an interior compartment, such that a continuous feeding of a liner is advanced without the need to access the interior compartment of the printer.

2. Description of Related Art

The present invention is directed to large industrial printers such as the MICR Printer/Check Model LN-30 printer which is typically used for printing checks and lottery tickets. Large scale printers such as these operate continuously for hours to generate mass printing output. In order to maintain schedules and operate efficiently, the printer must be operating without constant maintenance and attention by workers. Any improvement which reduces either the downtime of the printers or the intimate attention of a user is a valuable addition to the process.

In the operation of these printers, a liner is placed between the hammer bank and the target material to be printed on in order to enhance the quality of the printing. One example of a liner is Kapton, a thin Mylar-like material which is used in conjunction with the LN-30 printer. Kapton is manufactured by Dupont. The liner is sold on rolls, and individual sheets are pre-cut by the user for use in the printer.

The Kapton liner is used to enhance the printing quality of the printer. The Kapton material is designed to evenly distribute the impact force of the hammers to the drum when printing multi-line characters and symbols. Each section of Kapton liner can be used to print approximately 15,000 lines of print before advancement of the liner is required. Based on a printing volume of 12 hours per day at 5,000 lines per hour, the Kapton requires repositioning approximately every three hours or four times a day.

In the prior art, in order to position the Kapton between the target material and the hammer, an inner compartment must be accessed where the actual printing occurs. A sheet of Kapton is manually placed at the position where the hammers strike the target material on the printer roller. The sheet of Kapton is approximately six inches wide by 2 and a half inches long, and can be secured by pegs, by magnets, or the like. Care must be taken to ensure that the Kapton is aligned properly, and that the Kapton is sufficiently taut to ensure proper printing.

As printing occurs, the Kapton sheet progressively degrades due to the repeated striking by the hammer until the quality of the printing suffers. At this point, the Kapton sheet can usually be manually adjusted once or twice to position virgin Kapton on the present sheet at the designated strike area. Manually adjusting the Kapton involves stopping the printer and disconnecting the power. The interior of the printer must be accessed, and the Kapton realigned manually. Repositioning or replacing the Kapton sheet is a tedious and time-consuming process Although repositioning the Kapton allows more of the area on the sheet to be utilized, the majority of the area on the sheet goes unused because it lies on the periphery where mounting occurs. This task is extremely labor intensive, and Kapton replacement is required approximately every 3 hours of operation.

Every time the printing operation is halted in order to replace or reposition the Kapton liner, the power is disconnected and the internal compartment is accessed. Positioning the Kapton liner is time consuming, and opening the internal compartment exposes the printing operation to dust and contaminants. Once the Kapton liner is in place, the printer must be restarted and the initiation procedure requires an initial warm-up period. Thus, significant costs in downtime and wear, as well as the constant need for special attention, are associated with the continuous replacement of the Kapton liner.

OBJECTS AND SUMMARY OF THE INVENTION

In order to reduce the costs and downtime as a result of the continuous repositioning or replacement of the liner, the present invention discloses a tensioner and system for continuous liner feeding without the need to manually position the liner or access the internal printing compartment. Instead, the entire roll of Kapton is mounted within the compartment and held in place with a specially designed tensioner to keep the necessary tautness in the liner. In a preferred embodiment, the tensioner is combined with a one direction lead roller which advances the liner as it takes up the spent portion. The tensioner and the one direction roller maintain the liner in a state of constant tension as is necessary for proper operation of the printer. An indexing lever is positioned on the external portion of the printer such that the Kapton liner can be advanced without accessing the internal compartment, and without the need to turn the printer's power off. Additionally, the incremental advancement by the indexing lever allows far more of the Kapton liner to be used since there is no dedicated mounting area, thereby increasing the economic benefit of the present invention.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a tensioner and system for advancing a printer liner over a hammer impact area without accessing the interior compartment of the printer.

Figure 1:
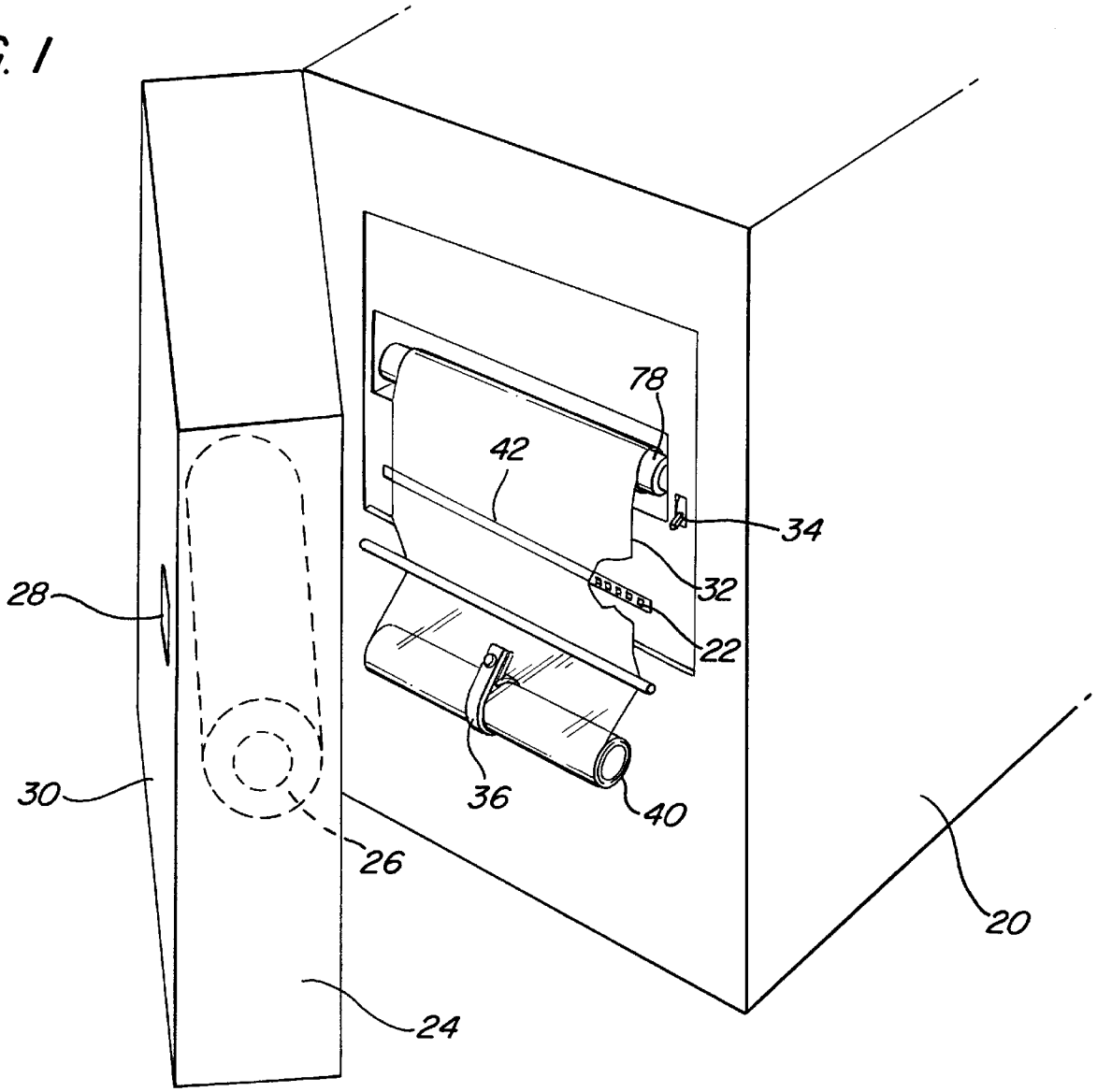
FIG. 1 is an elevated, perspective view of the printer door ajar exposing the tensioning system of the present invention.

FIG. 1 illustrates the principles and objectives of the present invention. A large capacity printer 20 includes a bank of hammers 22 which strike a target material and ribbon (see FIG. 3) to generate a character on the target material. A large door 24 is opened to access the internal compartment where the printing occurs. Typically, opening the door involves stopping the printing process and disconnecting power to the printer, and resuming the printing process necessitates a warm-up period delaying the printing operation. Inside the large door is a roller 26 which is aligned with, and cooperates with the hammer bank to generate the characters.

To obviate the need to continually open the printer door, the present invention preferably includes a modified door 24 having a window 28 on the front panel 30. The window provides access to an advancement mechanism 34 of the present invention which advances the Kapton liner 32 without the need to access the internal compartment. When the door is closed, the advancement mechanism 34 protrudes from the internal compartment through the window 28 such that it may be operated while the door 24 is closed.

Figure 2:
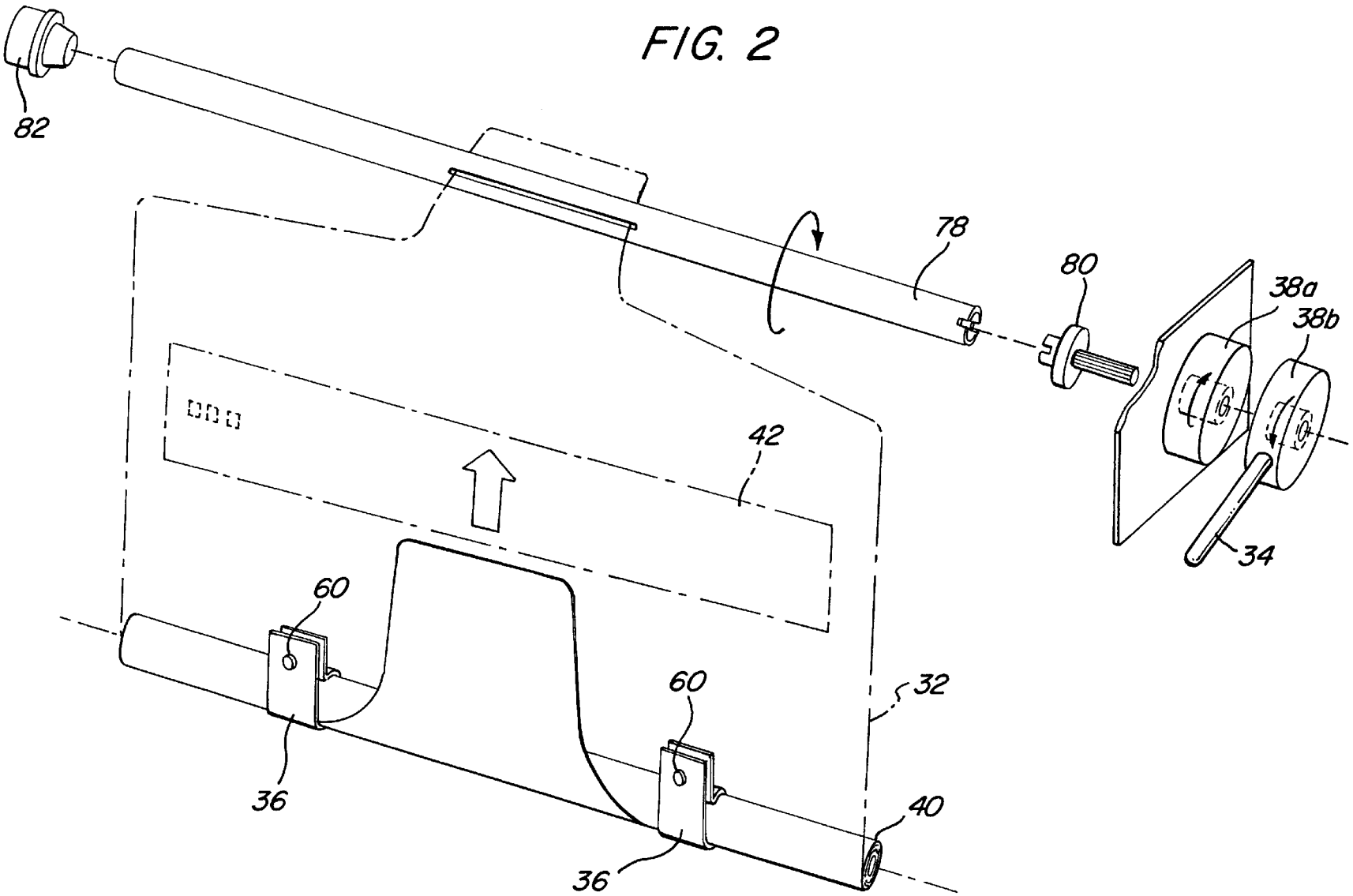
FIG. 2 is an elevated, perspective exploded view of the tensioning system.

FIG. 2 illustrates the principles of the tensioning system, including a specially-designed tensioner 36, a take-up roll 78, a take-up roll advancer 34, and a single direction clutch 38*a*, 38*b* for advancing the take-up roll 78 while maintaining tension in the liner 32. The tensioner, or pair of tensioners 36 hold a roll 40 of liner below the target area 42 where the hammers 22 strike the liner 32. The roll 40 of liner feeds through the tensioner 36 which allows the liner 32 to unfurl as it is withdrawn by the take-up roll 38. The take-up roll 78 is journalled within the inner compartment at a first end via a hub 82 and a second end via geared connector 80, and collects spent liner as the advancer 34 is operated, shown here to be a lever but within the scope of the present invention could be a dial, wheel, knob, or other mechanism. An important feature of the present invention is the unidirectional clutch 38*a*, 38*b* connected to the advancer 34 which rotates the take-up roll 78 in a single direction without relaxation or recoil in the opposite direction. As a result, due to the tension provided by the tensioner 36 (explained more fully below), the liner 32 is maintained in an appropriately taut condition over the impact or target area 42 thereby encouraging better printing results.

The single direction clutch 38*a*, 38*b* is comprised of a first geared component 38*a* operating in one direction coupled to a second geared component 38*b* operating in an both rotational directions. The rotation of the second component 38*b* in a preferred direction causes the first component 38*a* to rotate in conjunction with the second component 38*b*, but counter rotation of the second component 38*b* does not rotate the first component 38*a* in either direction. If the first component 38*a* is rigidly mounted to the take-up roll 78 using the geared connector 80, the rotation of the second component 38*b* in the preferred direction causes the take-up roll 78 to rotate, whereas a rotation of the second component 38*b* in the non-preferred direction does not affect the take-up roll 78. Thus, by advancing the index lever 34 in the preferred direction, the take-up roll 78 will advance the liner 32 producing virgin liner over the target area 42. Operation of the one-way clutch assembly prevents the liner 32 from releasing its tension due to relaxation or recoil of the take-up roll 78. In this manner, in conjunction with the frictional stopper 60 on the tensioner 36, tension is maintained in the liner 32.

Figure 3:
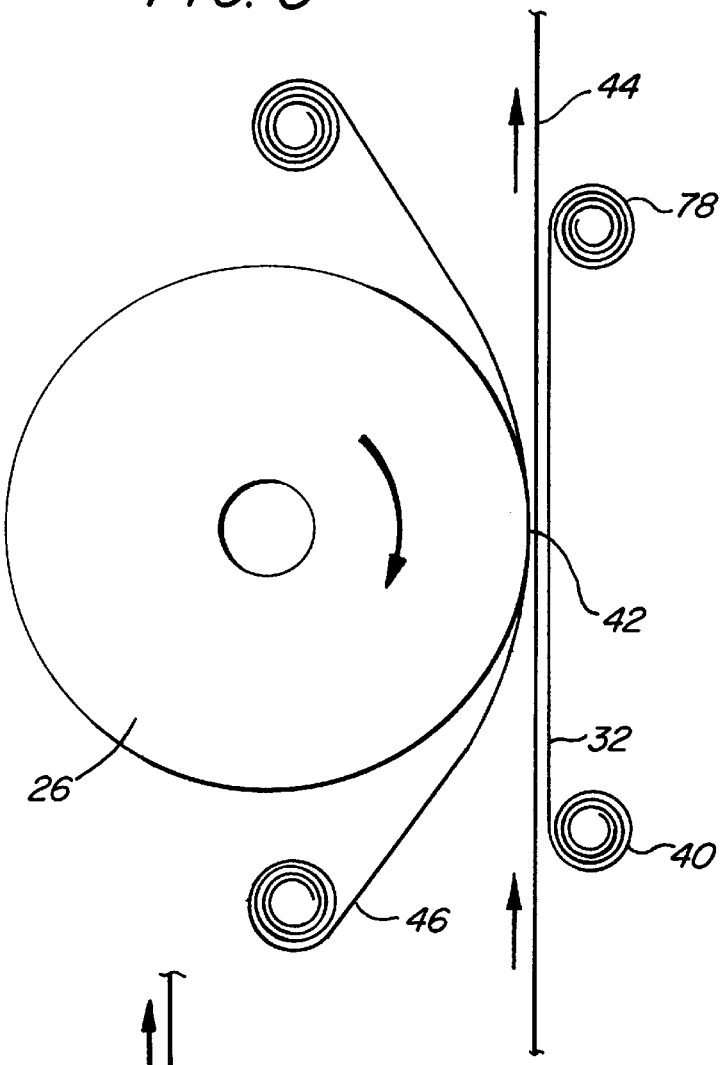
FIG. 3 is a side view of the tensioning system in relation to the drum and substrate material.

FIG. 3 illustrates the relationship of the liner 32 to the target material 44 to be printed on. A roll of target material 44, such as blanks for lottery tickets, is continuously fed through the printing area 42. A large cylindrical drum or roller 26 provides the impact area where the hammers strike, similar in operation to a typewriter. Between the target material 44 and the drum 26 is a ribbon 46 which is continuously fed and advanced through the impact zone 42. When the hammers 22 impact the drum 26 the ink on the ribbon 46 is transferred to the target material 44. On the other side, the liner 32 is located between the hammer bank (not shown) and the reverse side of the target material 44, such that the hammers strike the liner 32 and not the substrate blanks 44. The liner 32 softens the impact of the hammer with the target material 44 which enhances the print quality. As the liner 32 within the impact area 42 degrades and print quality begins to be affected, the present system allows the liner 32 to be manually advanced by, for example, the indexing lever 34 shown in FIG. 2.

Figure 4:
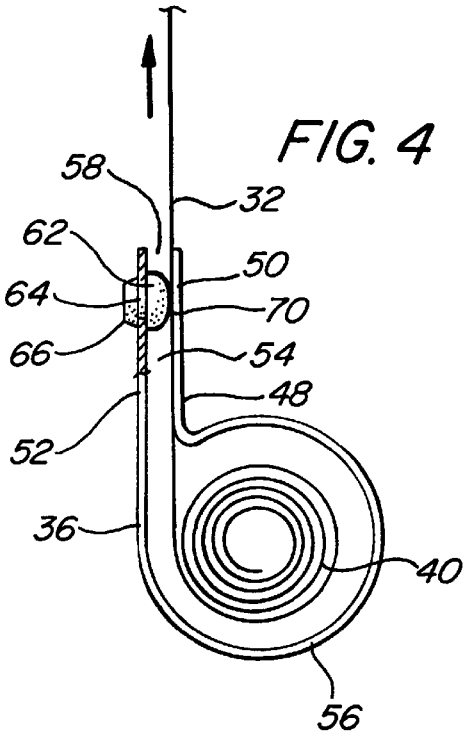
FIG. 4 is a side view of a preferred embodiment of the tensioner of the present invention.

FIG. 4 illustrates the tensioner, which preferably comprises a strip 48 of material such as 301 stainless steel (Rockwell Scale 41), but could be any suitable material having a suitable strength subject to the temperatures of the printer's internal compartment. As shown, the strip 48 is preferably of unitary construction and shaped so that the first end 50 is brought in proximity to the second end 52 in a generally spaced apart, parallel relationship to form a channel 54 therebetween. A middle portion 56 is shaped into a generally circular configuration which is used to house the roll 40 of Kapton or other liner. The roll 40 of Kapton is placed in the tensioner 36 such that the loose end of the roll feeds smoothly through the channel 54 as shown. As the roll 40 is unfurled, the liner 32 is fed through the channel 54 formed by the two end portions to the mouth 58, where it exits the tensioner 36.

To maintain tension in the liner 32, the tensioner 36 includes a frictional stopper 60 at the channel 54 which spans the gap between the inner surfaces of the end portions 50, 52. The frictional stopper 60 is preferably a rubber-like member having a large head portion 62 secured to one of the ends by a neck 64 which passes through a hole in the end and is secured on the outer surface by a shoulder portion 66. The frictional stopper 60 extends from its attached end to the inner surface of the opposed inner surface on the other end portion creating a localized pressure and the point of contact with the liner 32. As liner 32 is fed through the tensioner 36, the frictional stopper 60 presses the liner 32 against the opposed inner surface 70 and thereby resists movement of the liner through the tensioner 36. The pressure on the liner should be sufficient to resist movement in the absence of a tension force on the liner, but not so great as to tear the liner or prevent advancement of the liner by the advancing mechanism.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A tensioner for receiving a roll of sheet material and maintaining tension in the sheet material, the sheet material being unfurled and advanced over a designated printing area, comprising:

a unitary strip having a first end portion, a second end portion, and a middle portion wherein said first and second end portions are spaced apart to form a channel therebetween, and said middle portion forming a generally circular receptacle for receiving said roll of sheet material; and a frictional stopper mounted on an inner edge of said first end portion and extending to an inner edge of said second end portion, whereby sheet material from said roll is advanced from said roll between said first and second end portions against a frictional resistance due to contact with said frictional stopper.

2. The tensioner of claim 1 wherein said frictional stopper comprises a grommet mounted through a hole in said first end portion, said grommet having a round tip extending to the inner edge of said second end portion.

3. The tensioner of claim 2 wherein said frictional stopper is comprised of a rubber material.

4. A system for advancing sheet material from a roll past a designated printing area within the inner compartment of a printer without accessing the inner compartment comprising:

a first tensioner comprising a strip having a first end portion, a second end portion, and a middle portion wherein said first and second end portions are positioned in a spaced apart and generally parallel relationship, said middle portion forming a generally circular receptacle for receiving said roll of sheet material, and a frictional stopper mounted on an inner edge of said first end portions and extending to an inner edge of said second end portion to frictionally resist advancement of said sheet material between first and second end portions of said first tensioner;

a take-up roll located across said designated printing area from said roll of sheet material where spent sheet material is collected;

a clutch connected to said take-up roll where said clutch rotates said take-up roll, and advances said sheet material, without counter-rotation of said take-up roll to maintain tension of said sheet material between said take-up roller and said tensioner; and a take-up roll advancer on an exterior region of said printer and in communication with said clutch, wherein operation of said take-up roll advancer rotates said clutch, thereby advancing said sheet material, without accessing said inner compartment of said printer.

5. The system for advancing sheet material of claim 4 comprising a second tensioner about said roll of sheet material and generally spaced from said first tensioner.

6. A printer liner tensioner for maintaining tension in a roll of printer liner as the roll of printer liner unfurls comprising:

a unitary strip having a width which is less than the width of the roll, and a length which is shaped into a circular potion at a middle region, said middle portion supporting and in contact with the roll, and first and second end portions substantially parallel and spaced apart to define a channel therebetween for passing an unfurled length of printer liner therein through; and a frictional stopper at said channel to resist passage of said printer liner therein through.

* * * * *